United States Patent [19]

Dimitriu et al.

[11] Patent Number: 4,817,218

[45] Date of Patent: Apr. 4, 1989

[54] HAIR RINSING BASIN

[76] Inventors: Paul Dimitriu, 607 S. Hill St., Suite 910; John Boyajian, 607 S. Hill St., Suite 636, both of Los Angeles, Calif. 90014; Isaac Fils, 37350 51st St. East, Palmdale, Calif. 93550; George Sanchez, 22201 Ventura Blvd., Suite 201, Woodland Hills, Calif. 91364

[21] Appl. No.: 162,144

[22] Filed: Feb. 29, 1988

[51] Int. Cl.[4] ..... A45D 19/00

[52] U.S. Cl. ..... 4/515; 239/590.5

[58] Field of Search ..... 4/515, 516, 517, 518, 4/519, 520, 521, 522, 523; 132/9; 239/590, 590.5

[56] References Cited

U.S. PATENT DOCUMENTS

| | | | |
|---|---|---|---|
| 998,804 | 7/1911 | Salisbury | 4/518 |
| 2,507,386 | 5/1950 | Spiegel | 4/521 |
| 3,177,868 | 4/1965 | Wallace | 4/517 |
| 3,793,690 | 2/1974 | Wayne | 239/590 |

*Primary Examiner*—Robert W. Jenkins
*Attorney, Agent, or Firm*—Roger A. Marrs

[57] ABSTRACT

A device for use in connection with a hair rinsing procedure is disclosed herein having an inner and an outer shell nested together in conformal spaced apart relationship separated by movable water dispensing elements disposed in holes provided in the inner shell. Each element includes a tapered conical portion having several grooves for conducting water through each inner shell hole into a common rinsing cavity. Each water dispensing element carries resilient legs bearing against the outer shell urging the tapered conical portion into each respective hole and is further provided with a stop adapted to engage with the outer shell when the element is depressed. A pressurized water source is detachable coupled to the outer shell for introducing water into a channel between opposing surfaces of the inner and outer shells while the inner and outer shells include coaxially disposed drainage apertures for conducting waste rinse water into a basin.

8 Claims, 1 Drawing Sheet

FIG. 1.
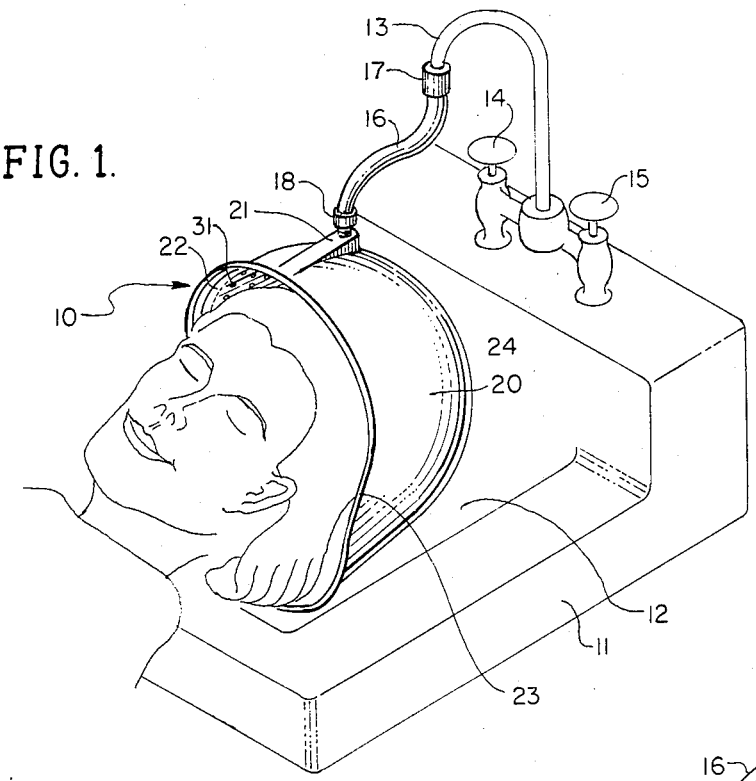
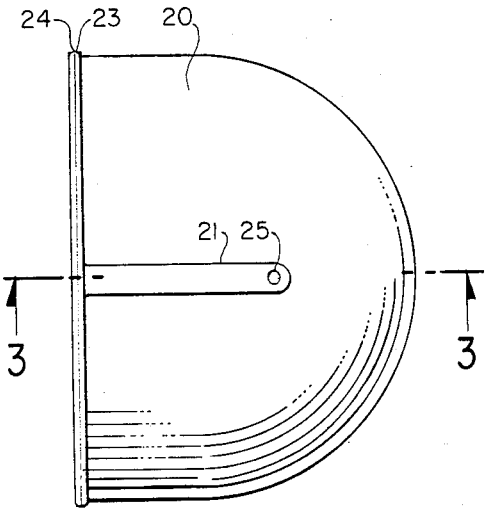
FIG. 2.
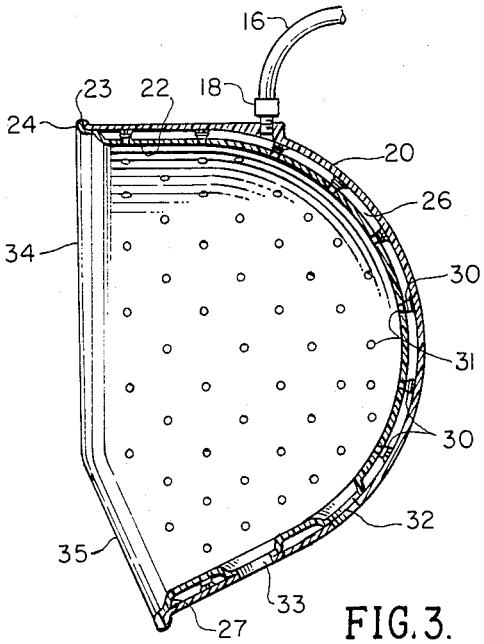
FIG. 3.
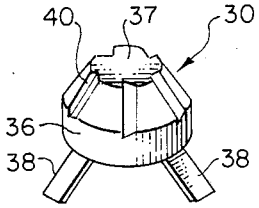
FIG. 4.
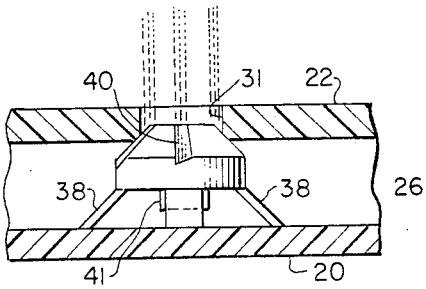
FIG. 5.

HAIR RINSING BASIN

BACKGROUND OF THE INVENTION

1. Field of the Invention

The present invention relates to the field of personal hygienic apparatus and beauty aids and, more particularly, to a novel apparatus for rinsing chemical solutions from a person's hair by substantially flushing the hair with water and conducting waste water bearing the solution into a drain.

2. Brief Description of the Prior Art

It is the conventional practice in the beauty field to employ a multiplicity of chemical solutions directly onto the hair of a woman undergoing a beauty treatment. In this connection, the chemical solutions are maintained on the hair for a particular period of time followed by rinsing or flushing of the hair to remove these solutions in order to stop the treatment. The current practice is to place the woman in front of a sink so that by placing her head in an inverted position into the sink, discharge water from a faucet can be directed by hand through the hair for chemical solution removal.

Although this procedure is successful for its intended purpose, problems and difficulties are encountered which stem largely from the fact that splashing of the water occurs so that waste water leaves the sink and deposits on the floor or person undergoing the procedure, rinse water is not thoroughly distributed throughout the hair for rinsing purposes and the rinsing procedure requires substantial attendance and manipulation of the hair by the beautician during the rinsing procedure. Therefore, it can be seen that by employing the conventional procedure, very little control is maintained by the beautician over the waste water as well as the general procedure of rinsing.

Therefore, a long standing need exists to provide an apparatus for achieving a thorough hair rinsing so as to remove chemical solutions and which will control waste water so that it may be conducted for disposal purposes.

SUMMARY OF THE INVENTION

Accordingly, the above problems and difficulties are obviated by the present invention which provides a novel hair rinsing device having a pair of rigid hemispherical shells nested together to define a water passageway between opposing surfaces so as to conduct pressurized water from an inlet in the outer shell of the pair to a plurality of holes in the inner shell of the pair. Water dispersement means occupy each of said plurality of holes movable between an operative water dispersing position and a cleaning position. Drainage means are cooperatively provided between said inner and said outer shells of said pair. The envelope shape or configuration of said shells allows temporary retention in a conventional wash basin so as to accommodate insertably receiving of the user's head while the user is lying in a prone position.

Therefore, it is among the primary objects of the present invention to provide a novel rinsing apparatus for rinsing and cleansing the hair of chemical solutions during a beauty treatment which not only thoroughly rinses the hair with fresh, clean water but removes the rinse water without splashing.

Another object of the present invention is to provide a novel rinsing apparatus for cleaning harmful chemicals from the hair which is coupled to a pressurized source of water and which forcibly discharges the water throughout the hair of the user in a controlled manner whereby the rinse water is suitably conducted exteriorly of the apparatus for drainage and disposal.

Still another object of the present invention is to provide a novel device for conducting pressurized water through a plurality of water dispensing elements into the hair of the user for rinsing chemical solutions therefrom and which includes means for draining waste rinse water from the apparatus.

Yet another object of the invention resides in providing a hair rinsing device for use with a conventional wash basin and for insertably receiving the head of the user while in a prone position and which incorporates a plurality of water dispersing elements having self cleaning means.

Another object resides in the provision of a water dispersing means movably disposed in an opening provided in a nested shell that is positionable between an operative position for discharging pressurized water and a cleaning position for removing debris or foreign matter from the opening.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a front perspective view showing the novel hair rinsing apparatus of the present invention disposed in a conventional wash basin or sink preparatory for use in the procedure of rinsing the hair of a person;

FIG. 2 is a top plan view of the novel hair rinsing apparatus shown in FIG. 1;

FIG. 3 is an enlarged cross-sectional view of the hair rinsing apparatus as shown in FIG. 2 as taken in the direction of arrows 3—3 thereof illustrating the water discharge orifices or jets provided in the inner shell of a nested pair of shells;

FIG. 4 is an enlarged perspective view of a water dispersing element used in the embodiment of FIG. 3; and FIG. 5 is an enlarged fragmentary cross-sectional view of the pair of shells showing the water dispersing element movably disposed in a water discharge orifice or opening.

DESCRIPTION OF THE PREFERRED EMBODIMENT

Referring to FIG. 1, the novel hair rinsing device of the present invention is illustrated in the general direction of arrow 10 which is employed in connection with a conventional sink or wash basin 11 having a central cavity which insertably receives the novel hair rinsing device. The cavity is identified by numeral 12 and it is to be understood that the sink or wash basin 11 is a stationary fixture which is not portable. The wash basin includes a source of pressurized water indicated by faucet 13 which source is under control of hot and cold water taps 14 and 15 respectively. The device 10 is placed into the cavity 12 in such a manner that the user's head may be insertably disposed within the interior of the device so that the user's hair is in position for receiving multiple streams of water for effecting the rinsing procedure.

The device 10 includes a continuous flexible tube 15 having a coupling 17 secured at one end for detachably connecting with the end of faucet 13. The opposite end of the tube 16 is connected, via a coupler 18, to an inlet leading into a passageway between a pair of inner and outer shells comprising the device 10. The outer shell is identified by numeral 20 which incorporates an integrally formed thickened portion or shoulder 21 in which the fluid inlet is provided to which coupling 18 is removably attached. The inner shell is identified by numeral 22 and the pair of shells are conformal in shape so as to be nested together with the inner shell residing within the cavity of the outer shell. The edge marginal regions of the pair of shells are adhesively attached together such as by an adhesive seam 23. Also, it is to be noted that the terminating edge of the inner bowl-shaped shell 22 terminates in an outwardly projecting flange 24 against which the terminating edge of the outer bowl 20 butts into sealing relationship when adhesively attached or bonded together. The opposite side of the flange 24 from its side in abutment with the terminating edge of bowl 20 is smooth and rounded so as to conveniently accommodate the positioning of the user's head so that the user's hair is in position for cleansing and rinsing.

Referring now in detail to FIGS. 2 and 3, it can be seen that the inlet for conducting water between the opposing surfaces of the inner and outer shells is in the shoulder 21 and is identified by numeral 25. The outwardly extending flange 24 is illustrated and it can also be seen, particularly in FIG. 3, that a passageway, broadly identified by numeral 26, is defined between the spaced apart opposing surfaces of the inner and outer shells 20 and 22. The shells are maintained in spaced apart relationship by means of an integrally formed step, identified by numeral 27, provided on the edge marginal region of the inner shell 22 immediately adjacent to the outwardly projecting flange 24. Therefore, the terminating edge of the outer shell rests against the flange on the step 27 so that a well defined space or passageway is established between the opposing surfaces of the shells. This spacing is maintained by provision of a plurality of water dispersion elements, such as element 30, which is representative of a plurality of elements disposed between the pair of shells.

The inner shell 22 is provided with a plurality of apertures or holes, such as hole 31, which are arranged in a predetermined pattern and wherein each of the apertures or holes is intended to receive the water dispersing portion of the element 30.

FIG. 3 further illustrates drainage apertures 32 and 33 which are formed in the lower portion of each of the shells and include a tapered sidewall formed in the inner shell which communicates with an opening in the outer shell to define each of the drainage openings. Therefore, any accumulation of waste water within the inner shell will be conducted out of the shell through the drainage openings. Furthermore, it is to be noted that the lower portion of the semicircular shells is angularly disposed with respect to a front leading edge, identified by numeral 34, wherein the angled frontal edge is identified by numeral 35. The angled edge is to accommodate the user's hair when the user's head is partially inserted into the rinse cavity of the inner shell.

Referring now in detail to FIGS. 4 and 5, the novel water dispersing element 30 is more clearly shown which includes a central body 36 carrying a conical tapered dispersing element 37 on one end and a plurality of flexible legs 38 on the other end. The conical dispersing element 37 includes a plurality of grooves 40 and it is intended that the tapered conical element be inserted into the opening 31 in the inner shell. Thus, water buildup in the passageway 26 will be conducted into the rinsing chamber of the inner shell via the plurality of grooves 40 on each of the dispersing elements. Except for the presence of the plurality of grooves on each of the dispersing elements, each of the holes 31 would be blocked since the presence of the dispersing element substantially occupies the area of each opening. The dispersing elements are self-centered within the openings since the taper of the element permits self-adjustment into each of the respective openings. The end of the element 30 opposite from its end carrying the conical water dispersing grooves carries a plurality of resilient legs 38 which bear against the inner surface of shell 20. Therefore, the conical portion 37 bears against the inner edge of the hole 31 while the legs 38 bear against the opposing surface on the shell 20. The legs are resilient so that each element may be depressed by finger pressure or the like to recede into the passageway 26, causing the legs 38 to spread. Such action is for the purpose of clearing any debris, foreign matter or the like from the grooves 40 or the holes 31. The element 30 can only be depressed so far because of interference of a limit stop 41 with the inner surface of shell 20, as shown in FIG. 5. Therefore, each element can only be depressed so far into the passageway 26 before the limit stop causes further depression to cease. The legs 38 are resilient and will spread or expand as the element is depressed. Upon release of the element, the resilient legs will cause the element to advance so that the conical portion of the element again engages the edges of the hole 31.

Therefore, it can be seen that the novel rinsing device of the present invention is portable and may be readily placed into the basin of an existing wash stand or sink and that connection is readily made to a source of pressurized water via flexible tube 16 and its couplings 17 and 18. Water is introduced into the passageway 26 for distribution about the entire surface of the inner shell 22 for distribution to the plurality of holes or openings 31. The respective dispersion elements 30 cause the flow of water to exit via grooves 40 so that flow control is established. Primary control between a high pressure water stream and a mere mist is under the control of the faucets 14 and 15 which control the pressure of water introduced to passageway 26.

Cleaning of the openings is achieved by depression of the dispersing elements within the chamber 26 where the stop 41 prevents complete dislodgement from the opening, and release of the element permits the resilient legs 38 to contract, urging the element to re-seat itself into the opening.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A hair rinsing device removably situated in a conventional sink basin comprising:

a pair of substantially hemispherical shells of conformal configuration nested together in spaced apart relationship to define a fluid passageway between opposing surfaces of said pair of shells;

said pair of shells constituting an inner and outer shell having terminating edges joined to establish said passageway;

said inner shell of said pair having a multiplicity of openings communicating said fluid passageway with a rinsing cavity of said inner shell; and a plurality of fluid dispersing elements movably disposed in said passageway between said shells and having a grooved conical portion disposed in said inner shell opening, respectively, for discharging fluid carried in said passageway therethrough into said rinsing cavity.

2. The invention as defined in claim 1, including:

drainage means carried on said device conducting fluid from said rinse cavity exteriorly of said pair of shells.

3. The invention as defined in claim 2 wherein each of said fluid dispersing elements includes:

a circular body separating said conical portion from at least a pair of resilient outwardly radiating legs;

said conical portion adapted to substantially occupy its respective opening and seated in abutment against the circular edge of said opening; and said resilient legs slidably bearing against the surface of said outer shell.

4. The invention as defined in claim 3 including:

stop means carried on said body surrounded by said legs in spaced relationship to said outer shell.

5. The invention as defined in claim 4 including:

an inlet provided in said outer shell for introducing pressurized water to said fluid passageway.

6. The invention as defined in claim 5 wherein:

said shells are rigid and include edge margin connecting means joining the adjacent edge marginal areas of said shell together wherein said connecting means establish the spacing between opposing surfaces of said shells.

7. The invention as defined in claim 6 wherein:

said conformal shells include an angular edge extending along the lower portion of said shells cooperating with said drainage means for draining said inner shell rinse cavity.

8. A water dispersement element comprising:

a circular body terminating at one end in a frustaconical portion provided with grooves along the tapered conical portion adapted to conduct pressurized water therealong and a plurality of resilient mounting legs outwardly radiating from the opposite end of said body.

* * * * *